United States Patent [19]

Schwartz

[11] 3,994,089

[45] Nov. 30, 1976

[54] COUPON BEARING LABEL

[76] Inventor: Arthur Schwartz, 62 Valley Lane West, North Woodmere, Long Island, N.Y. 11598

[22] Filed: Jan. 5, 1973

[21] Appl. No.: 321,249

[52] U.S. Cl. ..... 40/310

[51] Int. Cl.[2] ..... G09F 3/00

[58] Field of Search ..... 40/310, 312, 5, 306; 283/18, 21, 56, 22, 19, 20, 1 B; 206/DIG. 22; 229/70, 73

[56] References Cited

UNITED STATES PATENTS

| | | | |
|---|---|---|---|
| 761,357 | 5/1904 | Carpenter | 283/1 B |
| 1,273,105 | 7/1918 | Dyke et al. | 40/310 |
| 1,371,670 | 3/1921 | Dority et al. | 283/1 B |
| 2,928,583 | 3/1960 | Law | 229/73 |

FOREIGN PATENTS OR APPLICATIONS

| | | | |
|---|---|---|---|
| 506,116 | 10/1951 | Belgium | 283/18 |
| 10,439 | 1/1907 | United Kingdom | 40/5 |
| 913 | 10/1911 | United Kingdom | 40/5 |

*Primary Examiner*—Edgar S. Burr
*Assistant Examiner*—A. Heinz
*Attorney, Agent, or Firm*—William R. Liberman

[57] ABSTRACT

A coupon bearing label includes a pair of coinciding similar panels joined along their bottom edges by a fold line and along their side borders by a suitable adhesive, and tongues project upwardly from the panels and are spot or line joined by a suitable adhesive. The back panel is cemented to a receptacle and the face panel has score lines or lines of weakening delineating a separable rectangular coupon, the bottom score line coinciding with the fold line. In an alternative construction, the back and face panels are joined along a pair of their side edges by a fold line and an intermediate panel is delineated from the opposite edge of the back panel by a fold line and is sandwiched between the face and back panel. The free side border of the face panel is separably joined to the underlying border of the intermediate border by adhesive. Separable rectangular coupons are delineated by score lines on both the face and intermediate panels. The panels carry any desired information.

4 Claims, 8 Drawing Figures

COUPON BEARING LABEL

BACKGROUND OF THE INVENTION

The present invention relates generally to improvements in label devices and it relates paritcularly to an improved detachable coupon-bearing label for receptacles, containers and the like.

Where merchandise is dispensed in receptacles or containers it is frequently desirable to provide a detachable coupon or panel which is firmly attached to the container but may be easily removed, when desired, for numerous uses such as for bonuses associated with the sale of the merchandise. Where the merchandise is packaged in a cardboard box or similar container, the provision of a detachable coupon is simple and offers little difficulty. However, where the merchandise container is a bottle or jar formed of glass or a polymeric resin such as polyethylene or polypropylene, the application thereto of a detachable coupon presents many problems. It has been a common practice to fasten a coupon defining tag to the necks of bottles but this is an expensive procedure which leaves much to be desired and possesses numerous drawbacks and disadvantages.

SUMMARY OF THE INVENTION

It is a principal object of the present invention to provide an improved label device.

Another object of the present invention is to provide an improved label device with a detachable section such as a rectangular coupon or the like.

Still another object of the present invention is to provide an improved combined label and detachable coupon which is easily applied to containers formed of glass in synthetic organic polymeric resins such as the polyolefins and the like.

A further object of the present invention is to provide a device of the above nature characterized by its low cost, attractive appearance, ease of application and use and high versatility and adaptability.

The above and other objects of the present invention will become apparent from a reading of the following description taken in conjunction with the accompanying drawings which illustrate preferred embodiments thereof.

In a sense, the present invention contemplates the provision, in combination with a receptacle having a wall, of a label and detachable coupon formed of a unitary blank and including superimposed back and face panels delineated from each other by a fold line, a layer of adhesive separably joining a pair of panel confronting borders, the panels including overlapping tongues separably interconnected by an adhesive inwardly of the outer edges of the tongues, the rear face of the back panel being adhered to the container wall and the face panel having formed therein lines of weakness delineating a plurality of edges of a coupon defined by a section of the face panel.

In accordance with a preferred form of the improved device the fold line delineating the panels is formed along their bottom edges, the panels being of rectangular shape and having upwardly tapered tongues at their tops which are joined by a medial spot of a suitable adhesive. The side borders of the panels are joined by bands or lines of suitable adhesive. The coupon is rectangular with all its edges defined by score lines or lines of weakness and its bottom edge coinciding with the fold line. According to an alternative construction the face panel extends laterally from the back panel as does an oppositely directed intermediate panel, the panels being separated by vertical fold lines and each being provided with an upwardly directed tongue. The intermediate panel is folded to overlap the back panel and the face panel is folded to overlap the intermediate panel. Detachable coupons are delineated on the face and intermediate panels by top and side score lines which extend to the panel bottom edges. A suitable adhesive joins the outer side border of the face panel to the confronting underlying border of the intermediate border and spots of adhesive join the confronting faces of the tongues of the three panels. All of the faces of the panels where are or may be exposed may bear any desired information.

The improved device is simple and inexpensive, easy to apply and use and of great versatility and adaptability.

DESCRIPTION OF THE PREFERRED EMBODIMENTS

Figure 1:
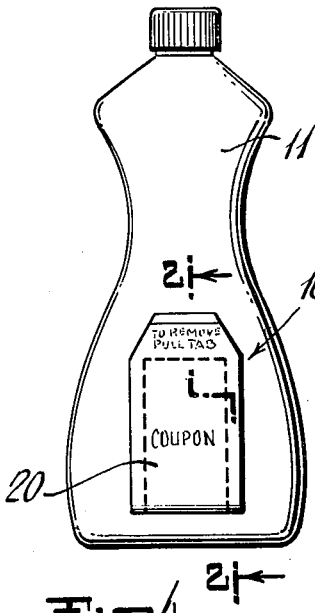
FIG. 1 is a front elevational view of a coupon label device constructed in accordance with the present invention, illustrated as applied to the face of a plastic bottle.
Figure 3:
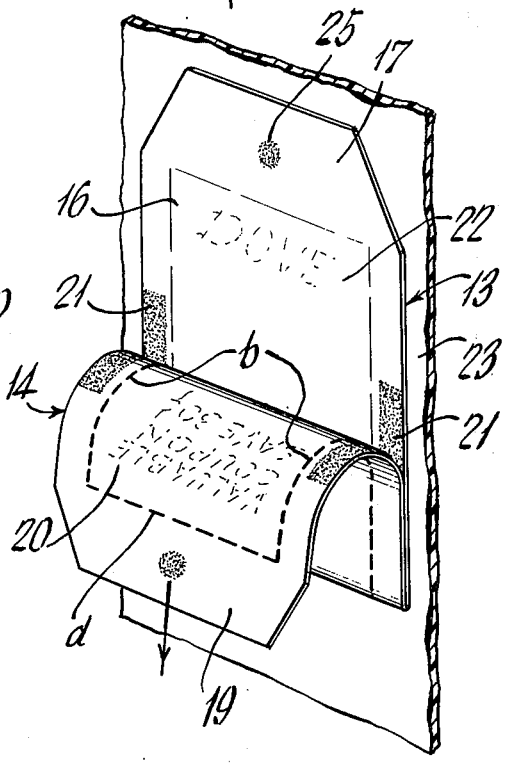
FIG. 3 is a fragmentary front perspective view thereof illustrating the separation of the label back and face panels.
Figure 2:
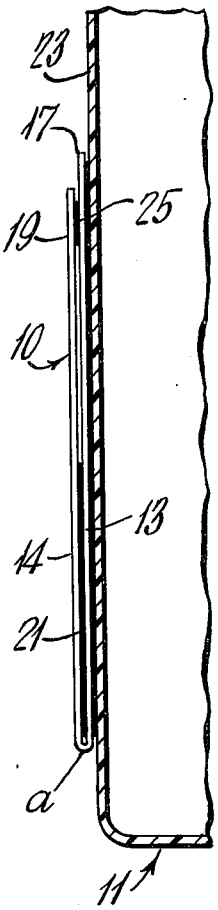
FIG. 2 is an enlarged sectional view taken along line 2—2 in FIG. 1.
Figure 4:
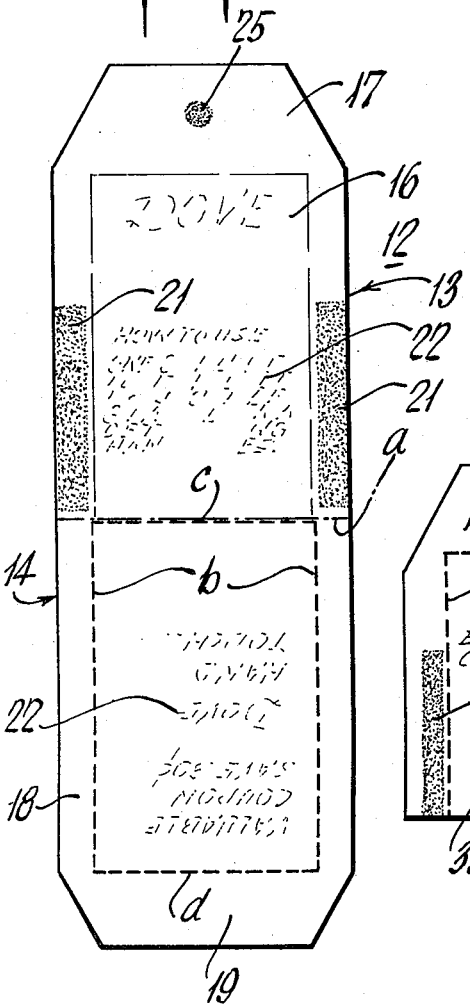
FIG. 4 is a plan view of the label shown in its fully open position.

Referring now to the drawings, particularly FIGS. 1 to 4 thereof which illustrate a preferred embodiment of the present invention, reference numeral 10 generally designates the improved coupon-bearing label which is illustrated as applied to the front face of a polyethylene or polypropylene bottle 11, it being understood that it may be applied to other types of receptacles formed of different materials. The label 10 is formed from a unitary precut paper blank 12 which is fabricated and assembled with the bottle 11 in any suitable or conventional manner.

Blank 12 is divided into a pair of similarly shaped back and face panels, 13 and 14 respectively, by a medial transverse fold line *a*. Panel 13 includes an inner rectangular section 16 extending from fold line *a* and terminating in a tongue-defining section 17 delineated by converging side edges and a transverse end edge, and panel 14 includes an inner rectangular section 18 and a tongue section 19 similarly shaped and symmetrical to sections 16 and 17 respectively, tongue 19 being somewhat shorter than tongue 17.

Formed in face panel section 18 is a rectangular detachable coupon 20 which extends from fold line *a* to the base of tongue 19. Coupon 20 is delineated by lines of weakness formed in face panel section 18 including parallel longitudinal side lines *b* formed inwardly of the side edges of panel section 18 to define therewith panel side borders, transverse and line *c* coinciding with fold line *a* and a transverse end line *d* coinciding with the base of tongue 19.

A spot 25 of any suitable adhesive is medially positioned on tongue 17 inwardly of its outer edge, and a pair of strips or bands 21 of adhesive are positioned along the side border of panel section 16 from points proximate fold line *a* to about the medial transverse axis of panel section 16. It should be noted that adhesive spot 25 and bands 21 may to great advantage be positioned on panel 14 instead of panel 13. Any desired information, 22, such as representations, instructions, directions and the like may be printed on the front fact of panel 13 and on the front and rear faces of coupon 20.

In the assembled condition of label 10, panel 14 is folded along line *a* to be superimposed on panel 13 and is separably adhered thereto by the adhesive bands 21 and spot 22. Label 10 in its folded condition is suitably cemented to the face of a well 23 of bottle 11.

To detach coupon 20 from label 10 the tongue 19 is pulled outwardly to break the adherence of adhesive bands 21 and accordingly to separate panels 13 and 14 from their overlapping condition. Coupon 20 is then detached from panel 14 by tearing it along the lines of weakness *b*, *c* and *d* and the remaining frame of panel 14 may be returned to overlying adhesion with panel 13. Advantageously, adhesive spot 25 and band 21 are located on panel 14 instead of panel 13 and in corresponding positions, and fold line *a* is defined by a line of weakness across the full width of the blank 13. With this latter construction, panel 14 is pulled from panel 13 and is completely separated therefrom by tearing along line *a*. Coupon 20 can then easily be detached by tearing along lines of weakness *b* and *d*.

Figure 5:
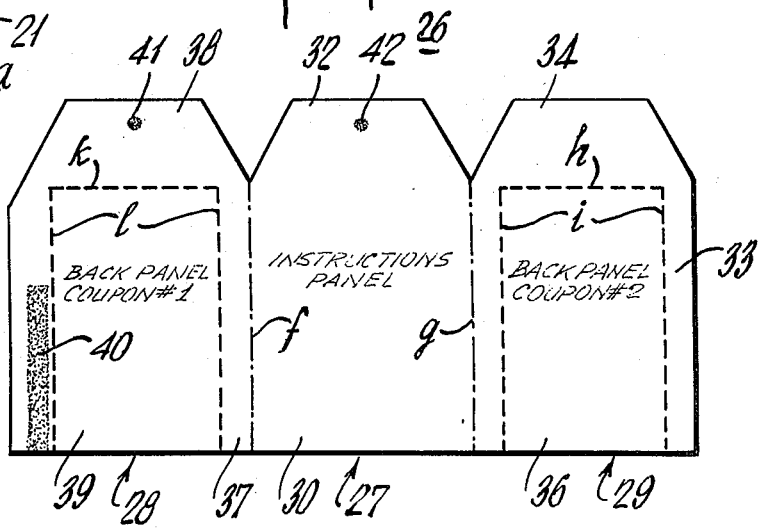
FIG. 5 is a plan view of another embodiment of the present invention shown in a fully open lay-flat condition.
Figure 6:
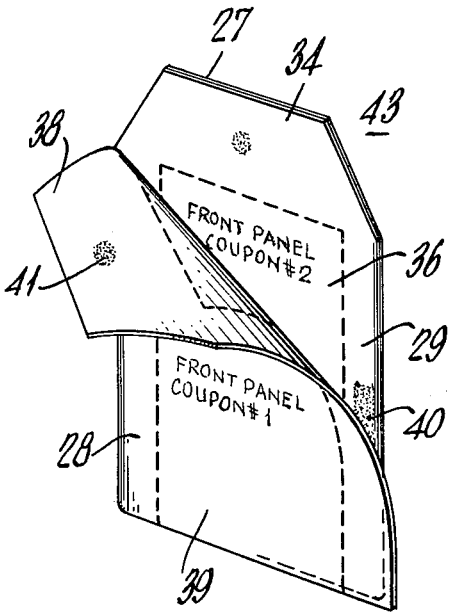
FIG. 6 is a perspective view thereof in an assembled condition and partially open.

In FIGS. 5 and 6 there is illustrated another embodiment of the present invention which, like that first described, is formed of a unitary paper blank designated by reference numeral 26. Blank 26 is divided by a pair of tranversely spaced vertical fold lines *f* and *g* which may be defined by score lines into back, face and intermediate panels 27, 28 and 29 respectively. Back panel 27 is delineated by fold line *f* and *g* and is demarked from panels 28 and 29 by such fold lines *f* and *g* respectively. The width of intermediate panel 29 is slightly less than that of back panel 27 and the width of face panel 28 is greater than that of back panel 27.

Front panel 27 includes a lower rectangular section 30 terminating at its top in a tongue-defining section 32 having upwardly converging side edges. Intermediate panel 29 likewise includes a lower rectangular panel 33 and an upper tongue 34. A detachable rectangular coupon 36 is formed in panel section 33 and is delineated by a transverse horizontal upper score line 37*h* coinciding with the base of tongue 34, and a pair of transversely spaced verticl score lines *i* which depend from the ends of scoreline *h* to the bottom edge of panel section 33 and are space inwardly from the side edges thereof. Face panel 28 includes a lower rectangular section 37 and an upper tongue 38. A coupon 39 is delineated in section 37 by an upper horizontal score line *k* and side vertical score lines *l* corresponding to score lines *h* and *i*.

Disposed along the inside face of the outer side border of panel section 37 is a band 40 of a suitable adhesive. A spot 41 of adhesive is medially located on the rear face of tongue 38 below its top edge and a spot 42 of adhesive is medially located on the front face of tongue 32 below the top edge thereof. Any desired information may be printed on the front face of back panel 27 and on both faces of panels 28 and 29.

In the assembled condition of label 43 from blank 26, panel 29 is folded about fold line *g* to superimpose panel 27 with the tongues 32 and 34 being separably joined by adhesive spot 42, and face panel 28 is then folded about fold line to overly panel 27 and 29, and is separably secured to the front face of panel 36 by band 40 and spot 41 of adhesive. The assembled label is applied to a receptacle by means of suitable cement between the rear face of back panel 27 and a face of the receptacle.

In detaching coupon 36 or coupon 39 or both, face panel 28 is folded away from intermediate panel 29 by pulling on the upper part of tongue 38 forwardly to break the adhesion of spot 41 and band 40 and the panel 28 is then turned away from the underlying panels about fold line *f*. The panel 29 is then opened in like manner, only the breaking of the adhesion of spot 42 being required. One or both of coupons 36 and 39 may then be detached by tearing along the score lines delineating the respective coupons. The remaining panel frames left following the removal of the coupons may be turned to their closed condition and maintained in such condition by the adhesive spots 41 and 42 and band 40. The fold line *f* and *g* may be defined by score lines permitting the detachment of panels 28 and 29 attendent the separation of corresponding coupons 39 and 36.

Figure 7:
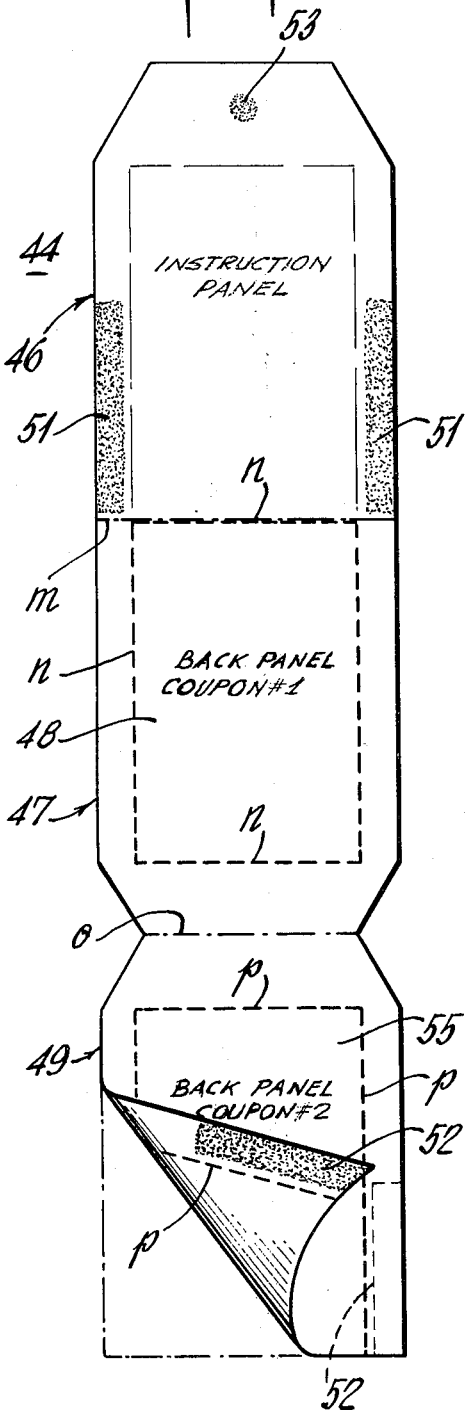
FIG. 7 is a plan view of another embodiment of the present invention shown in a fully open condition.
Figure 8:
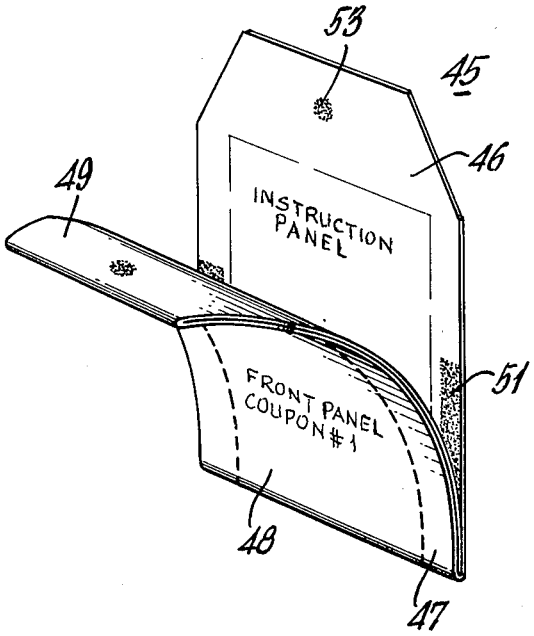
FIG. 8 is a perspective view thereof in an assembled condition and partially open.

The embodiment of the present invention illustrated in FIGS. 7 and 8 of the drawings differs from that first described primarily in that an additional intermediate couponbearing panel is provided in end-to-end connection with the face panel. Specifically the improved label 45 is formed of a unitary paper blank 44 which includes a back panel 46 and a face panel 47 separated by a transverse fold line *m*, panels 46 and 47 corresponding in shape, construction and association to panels 13 and 14 described above, each panel including a rectangular section terminating in a tongue-defining section. Score lines are formed in face panel 47 and delineate a detachable coupon 48 corresponding to coupon 20.

Extending longitudinally from panel 47 and delinated therefrom by a transverse fold line *o* is an intermediate panel 49 similar in shape to panel 47 but being slightly shorter. The tongues of panels 47 and 49 are joined end-to-end at fold line *o*. Score lines *p*, including a horizontal score line coinciding with the base of the tongue of panel 49, and vertical score lines which extend from the ends of the horizontal score line to the end edge of panel 49 delineate a detachable coupon 55 corresponding to coupon 48. Adhesive bands 51 and 52 are formed along the front side borders of back panel 46 and along the rear side borders of intermediate panel 49 respectively, and an adhesive spot 53 is medially formed on the front face of the tongue of back panel 46. Information is printed on the front face of back panel 46 and on both faces of panels 47 and 49. The label 43 is assembled from blank 44 by folding panel 49 about line *o* to overly a face of panel 47 which is the rear face of panel 47 in the assembled label 43. The superimposed labels 47 and 49 are then folded about the fold line separating panels 46 and 47, and the thus folded panels are releasably locked in their closed condition by adhesive bands 51 and 52 and adhesive spot 53.

The application and use of the label 43 are similar to those of labels 10 and 43 as explained above.

While there have been described and illustrated preferred embodiments of the present invention it is apparent that numerous alterations, omissions and additions may be made without departing from the spirit thereof.

I claim:

1. In combination with a receptacle having a wall, a label and detachable coupon device formed of a unitary blank and including a rectangular back panel and a rectangular face panel superimposed on and substantially coinciding with said back panel and delineated therefrom by a fold line, each of said panels having information printed thereon, means including a layer of adhesive separably joining at least one pair of borders of said panels, said panels being provided with mutually overlapping outwardly extending tongues, and an adhesive joining said tongues at a point inwardly of the outer edges of said tongues, the rear faces of said back panel and said tongue extending therefrom being adhered to said container wall and said face panel having formed therein lines of weakness delineating a plurality of edges of a section separable from said face panel, wherein said fold line is along the bottom edges of said panels and said tongues project upwardly, and said separable section is of rectangular configuration with its top and side edges delineated by said lines of weakness extending into the fold line, and including an intermediate panel extending laterally from said back panel opposite said face panel, and delienated from said back panel from a fold line, said intermediate panel being sandwiched between said face and back panels, and the outer side border of said face panel being separably joined to the overlying border of said intermediate panel by said adhesive.

2. The combination of claim 1, wherein said panels are of similar shape and in overlapping coincidence.

3. The combination of claim 2, wherein the confronting faces of said intermediate and back panels and said intermediate and front panels are separably joined by adhesive.

4. The combination of claim 1, wherein said fold line is along the bottom edges of said panels and said tongues project upwardly, and comprising an intermediate panel sandwiched between said back and face panels and joined to said face panel along a fold line along the upper edges of said intermediate and face panels, said face and intermediate panels having lines of weakness formed therein delineating respective separable sections.

* * * * *